US007722222B2

(12) United States Patent
Zheng

(10) Patent No.: US 7,722,222 B2
(45) Date of Patent: May 25, 2010

(54) LED LAMP ASSEMBLY

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 24 days.

(21) Appl. No.: 12/054,340

(22) Filed: Mar. 24, 2008

(65) Prior Publication Data

US 2009/0237923 A1 Sep. 24, 2009

(51) Int. Cl.
*F21V 29/00* (2006.01)

(52) U.S. Cl. ..... 362/294; 362/249.02; 362/249.06; 362/373; 165/104.33

(58) Field of Classification Search ..... 362/249.02, 362/249.06, 294, 373, 800; 165/104.33
See application file for complete search history.

(56) References Cited

U.S. PATENT DOCUMENTS 7,458,706 B1 * 12/2008 Liu et al. ..... 362/373
2005/0174780 A1 * 8/2005 Park ..... 362/294

* cited by examiner

*Primary Examiner*—Stephen F Husar
(74) *Attorney, Agent, or Firm*—Frank R. Niranjan

(57) ABSTRACT

An LED lamp assembly includes a pair of LED lamps facing opposite directions. Each LED lamp includes a heat sink having a heat absorbing portion and a heat dissipating portion. The heat absorbing portion has opposite first and second surfaces. The heat dissipating portion extends rearwards from the first surface of the heat absorbing portion. An outmost end of the heat dissipating portion defines a plurality of apertures and is located beyond an outmost end of the heat absorbing portion. The heat dissipating portions of the heat sinks are oriented towards each other and define a channel therebetween. The LED modules are mounted at the second surfaces the heat absorbing portions. Heat generated by the LED modules is absorbed by the heat absorbing portions and then transferred to the apertures and the channel via the heat dissipating portions, from where the heat is dissipated to surrounding air.

18 Claims, 3 Drawing Sheets

LED LAMP ASSEMBLY

BACKGROUND OF THE INVENTION

1. Field of the Invention

The present invention relates to an LED lamp assembly, and more particularly to an LED lamp assembly emitting light at opposite sides thereof.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of a heat sink to dissipate heat generated by the LEDs. The outer surface of the heat sink generally is a plane and the LEDs are arranged close to each other. When the LED lamp works, the LEDs mounted on the planar outer surface of the heat sink only form a flat light source, whereby the illumination area of the LED lamp is limited. In addition, the heat sink of the conventional LED lamp cannot efficiently dissipate the heat generated by the LEDs.

What is needed, therefore, is an LED lamp assembly having a large illumination area. Furthermore, the LED lamp assembly has a high heat dissipation efficiency.

SUMMARY OF THE INVENTION

An LED lamp assembly includes a pair of LED lamps. Each of the LED lamps includes a heat sink having a heat absorbing portion and a heat dissipating portion. The heat absorbing portion has a first surface and a second surface opposite to the first surface. The heat dissipating portion extends rearwards from the first surface of the heat absorbing portion. An outmost end of the heat dissipating portion defines a plurality of apertures and is located beyond an outmost end of the heat absorbing portion. The heat absorbing portions of the heat sinks of the LED lamps are located at opposite sides of the LED lamp assembly. The heat dissipating portions of the heat sinks are oriented towards each other. A channel is between the heat dissipation portions and communicates with the apertures. The LED modules are mounted at the second side the heat absorbing portions. Heat generated by the LED modules is transmitted to the heat absorbing portions of the heat sinks and then dissipated to a surrounding air through the apertures and the channel via the heat dissipating portions.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
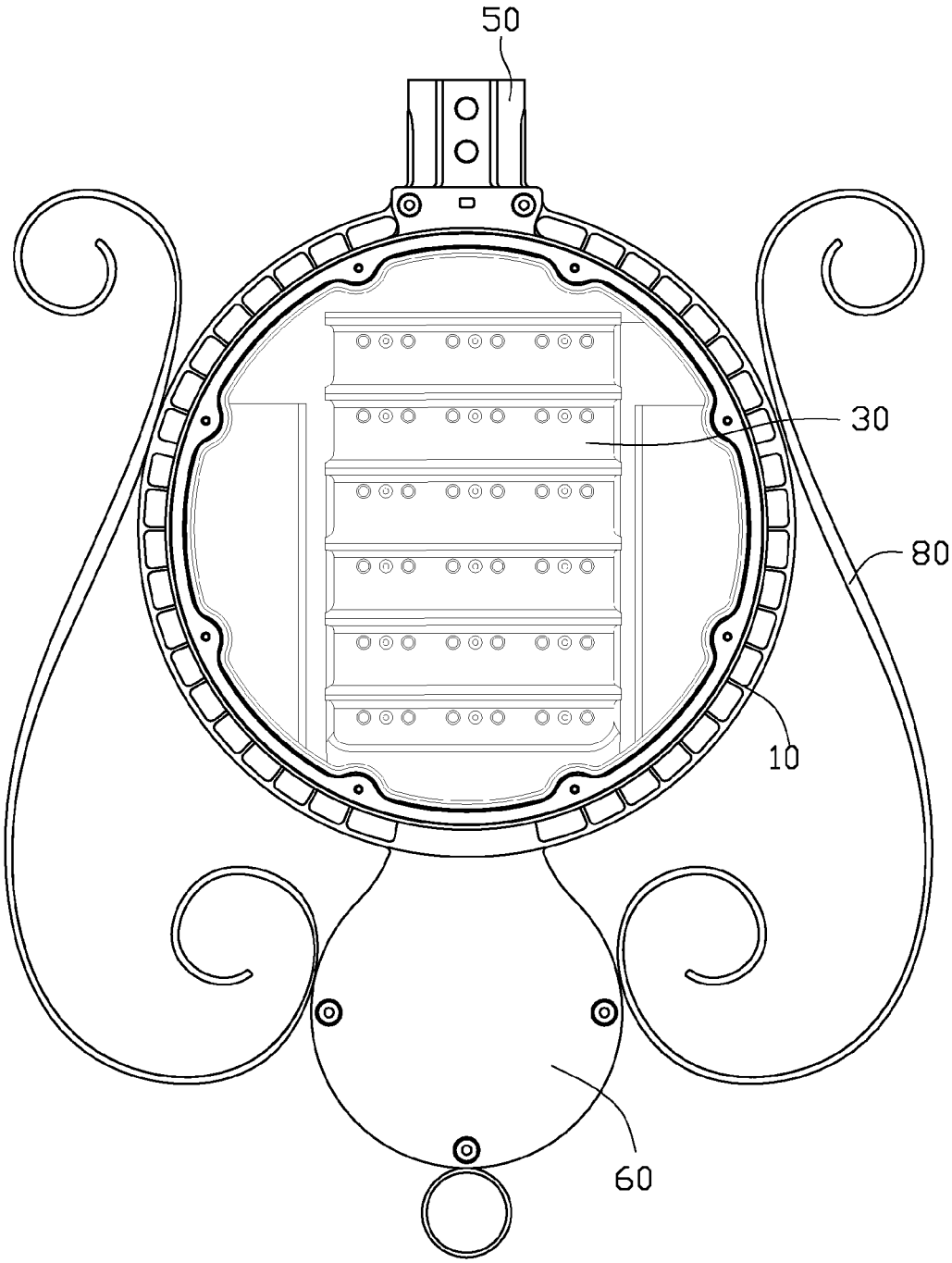
FIG. 1 is a front elevational view of a lamp assembly in accordance with a preferred embodiment of the present invention.
Figure 2:
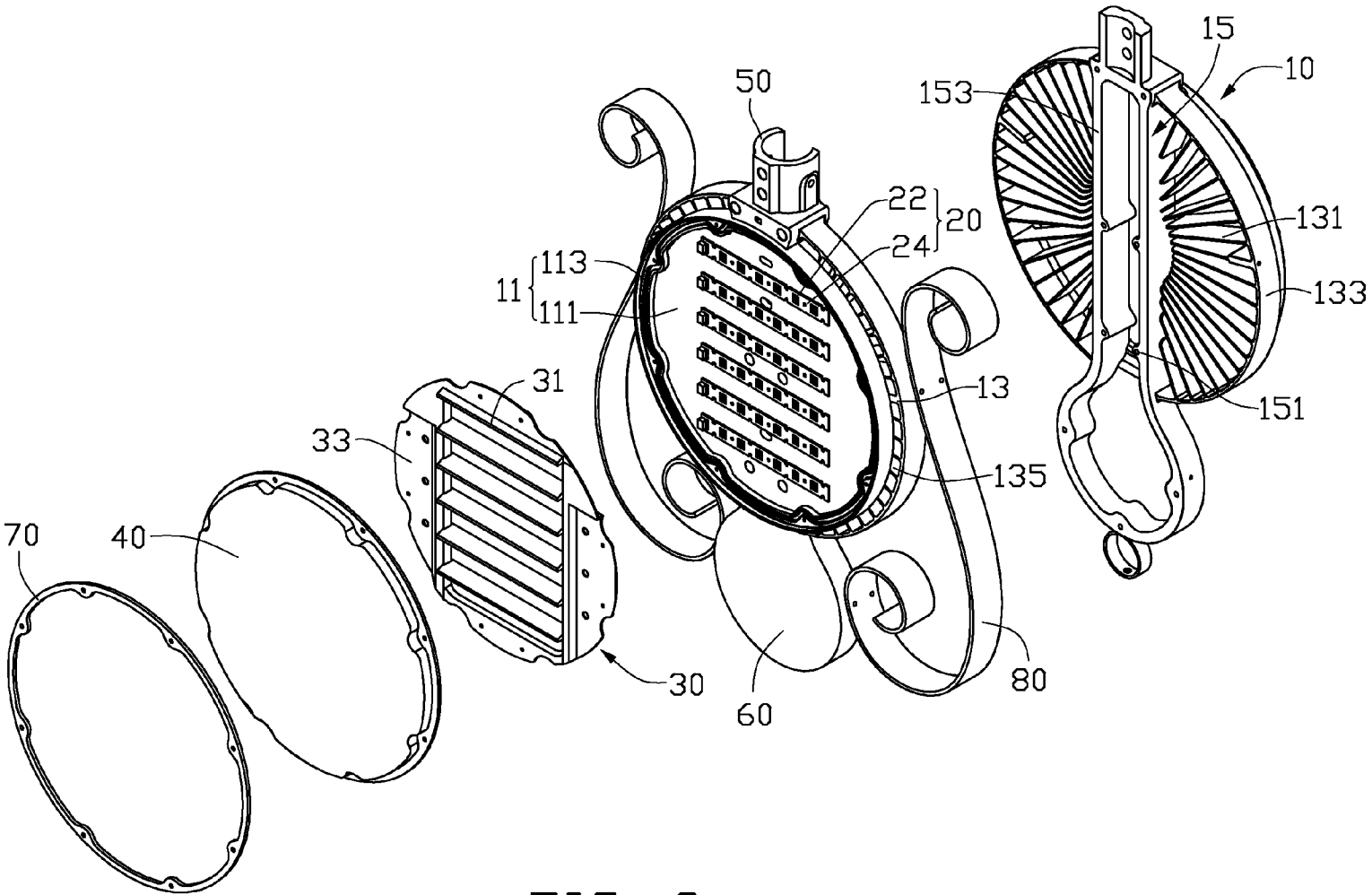
FIG. 2 is an exploded view of FIG. 1.

Referring to FIGS. 1-2, an LED lamp assembly (not labeled) comprises a pair of LED lamps (not labeled) symmetrical about each other. Each LED lamp comprises a heat sink 10, a plurality of LED modules 20 mounted on the heat sink 10, a reflector 30 mounted on the heat sink 10 and surrounding the LED modules 20, a transparent envelope 40 mounted around a periphery of the heat sink 10 to enclose the LED modules 20 and the reflector 30 therein. A lamp holder 50 is located at a top of the LED lamp assembly. A receiving member 60 is located at a bottom of the LED lamp assembly. The lamp holder 50 is configured for connecting with a supporting post so that the lamp assembly can be used as a suspension lamp. A driving circuit module (not shown) is received in the receiving member 60 for electronically connecting with the LED modules 20. A pair of S-shaped strips 80 is mounted on opposite sides of the LED lamp assembly to decorate the LED lamp assembly.

Figure 3:
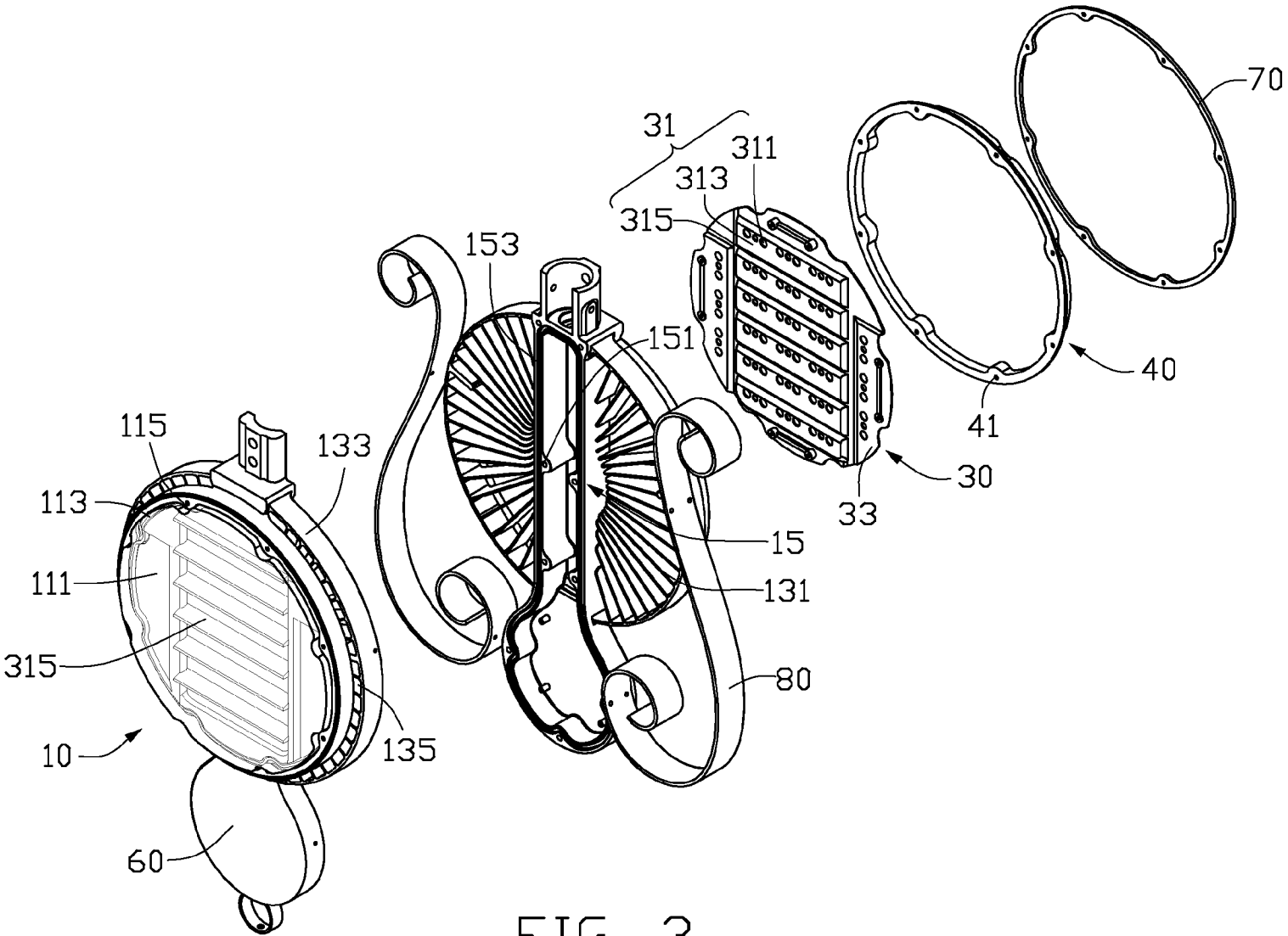
FIG. 3 is an inverted view of FIG. 2.

Referring to FIG. 3 also, the heat sink 10 of the LED lamp comprises a heat absorbing portion 11, an elongated connecting portion 15 extending outwardly from a centre of a rear surface (not labeled) of the heat absorbing portion 11, and a heat dissipating portion 13 extending from the rear surface of the heat absorbing portion 11 and around the connecting portion 15.

The heat absorbing portion 11 comprises a circular heat absorbing plate 111 and an annular sidewall 113 extending outwardly from an edge of the heat absorbing plate 111. The LED modules 20 are mounted on a front surface (not labeled) of the heat absorbing plate 111. The LED modules 20 are horizontally arranged from a top to a bottom of the front surface with a predetermined distance defined between two neighboring LED modules 20. The sidewall 113 encloses the LED modules 20 therein. The sidewall 113 forms a plurality of protruding portions 115 from an inner surface thereof. The protruding portions 115 are equidistantly spaced from each other and provided for engaging with the envelope 40.

The connecting portion 15 is mounted on the rear surface of the heat absorbing plate 115 and opposite ends thereof connects with the lamp holder 50 and the receiving member 60. The connecting portion 15 defines an elongated groove (not labeled) at a centre thereof. The groove of the connecting portion 15 communicates with the receiving member 60. Thus, wires (not shown) of the driving circuit module extend through the groove of the connecting portion 15 to electronically connect with the LED modules 20. The connecting portion 15 forms a plurality of mounting members 151 at opposite sides thereof. The connecting portions 15 of the heat sinks 10 are oriented towards each other. A plurality of screws (not shown) extends through the mounting members 151 of the heat sinks 10 to assemble the two LED lamps together. An rear side 153 of the connecting portion 15 is located in rear of a rear side (not labeled) of the heat dissipating portion 13. Thus, the heat dissipating portions 13 of the heat sinks 10 of the LED lamps are spaced from each other when the rear sides 153 of the connecting portions 15 of the two heat sinks 10 are abuttingly assembled together. Accordingly, a channel is defined between the heat dissipating portions 13 of the heat sinks 10 and around the connecting portions 15. An airflow can flow from a bottom to a top of the channel between the heat dissipating portions 13 of the heat sinks 10 of the LED lamp assembly to dissipate heat generated by the LED modules 20.

The heat dissipating portion 13 comprises a plurality of radial fins 131 and a sidewall 133 connecting the fins 131 and enclosing outmost ends of the fins 131 therein. The fins 131 are mounted on the rear surface of the heat absorbing plate 111 of the heat absorbing portion 11 and spaced from each other. Inner ends of the fins 131 are near to the opposite lateral sides of the connecting portion 15. The outmost ends of the fins 131 extend outwardly beyond an outmost edge (not labeled) of the heat absorbing plate 111 of the heat sink 10. Thus, an annular area (not labeled) is formed between the sidewall 133 and the outmost edge of the heat absorbing plate 111 of the heat absorbing portion 11. A plurality of apertures 135 is defined in the annular area. Each aperture 135 is defined between two neighboring fins 131, the outmost edge of the heat absorbing plate 111 and the sidewall 133. The apertures 135 are communicated with and guide airflow into the channel between the heat sinks 10.

Each LED module 20 comprises an elongated printed circuit board 22 and a plurality of spaced LEDs 24 evenly mounted on a side of the printed circuit board 32. The LEDs 24 of each LED module 20 are arranged along a longitudinal direction of the printed circuit board 22. Each LED module 20 is mounted in a thermally conductive relationship with the front surface of the heat absorbing plate 111 of the heat absorbing portion 11 and electronically connects with the driving circuit module.

Each reflector 30 has a circular configuration and comprises a mounting portion 33 and a reflecting portion 31 located within the mounting portion 33.

The mounting portion 33 is a circular plate and enclosed in the sidewall 113 of the heat absorbing portion 11. Screws extend through the edges of the mounting portion 33 and engage with the heat absorbing portion 11 to mount the reflector 30 on the heat sink 10. The reflecting portion 31 comprises a rectangular plate 313 with a row of through holes 311. A plurality of linear reflecting plates 315 each extends downwardly and frontwards from a corresponding rectangular plate 313 with a predetermined distance. Each through hole 311 corresponds to a corresponding LED 24. Each reflecting plate 315 has a length similar to that of the LED module 20 and reflects light emitted from the LED module 20 to enhance the illumination of the LED lamp.

The envelope 40 has a disc-like configuration and is made of glass or transparent plastic. The envelope 40 defines a plurality of through holes 41 corresponding to the protruding portions 115 of the heat absorbing portion 11. Screws (not shown) extend through the through holes 41 of the envelope 40 and engage with the protruding portions 115 of the heat absorbing portion 11 to mount the envelope 40 on the heat absorbing portion 11. The envelope 40 and the heat absorbing portion 11 define a space (not labeled) accommodating the LED modules 20 and the reflector 30 therein, whereby the LED modules 20 can have a sufficient protection for avoiding a damage caused by an unexpected force acting on the LED lamp. A gasket 70 is sandwiched between the envelope 40 and the sidewall 113 of the heat absorbing portion 11 to provide the space with a waterproof capability.

In use, when the LEDs 24 emit light, the light is reflected by the reflector 30. Heat generated by the LEDs 24 is absorbed by the heat absorbing portions 11 of the heat sinks 10. The heat is then transferred to the heat dissipating portions 13. Finally the heat is dispersed into ambient cool air through the fins 131. The air in the apertures 135 at the annular periphery of each of the heat sinks 10 and in the channel between the heat sinks 10 is heated. The heated air becomes lighter than the cool air, so that the heated air floats upwardly due to buoyancy and is replaced by the outside cooler air flowing upwardly from the bottom to the top of the heat sinks 10 into the heat sinks 10. The apertures 135 in the annular area of the heat sink 10 guide the airflow into the channel between the heat sinks 10, whereby the heat of the heat sinks 10 and accordingly the heat generated by the LEDs 24 of the LED module 20 can be effectively dissipated. Thus, the LED lamp assembly in accordance with the present invention has an improved heat dissipating efficiency for preventing the LEDs from overheating.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp assembly comprising:

a pair of LED lamps facing opposite directions, each of the LED lamps comprising: LED modules and a heat sink, the heat sink comprising a heat absorbing portion and a heat dissipating portion, the heat absorbing portion having a first surface and a second surface opposite to the first surface; the heat dissipating portion extending from the first surface of the heat absorbing portion, an outmost end of the heat dissipating portion defining a plurality of apertures and located beyond an outmost end of the heat absorbing portion;

wherein the heat absorbing portions of the heat sinks of the LED lamps are located at opposite sides of the LED lamp assembly, the heat dissipating portions of the heat sinks are oriented towards each other, and the LED modules of the two LED lamps are mounted at the second surfaces of the heat absorbing portions of the two LED lamps of the LED lamp assembly.

2. The LED lamp assembly as claimed in claim 1, wherein the heat dissipating portions of the two heat sinks of the LED lamps are spaced from each other and a channel is defined between the heat dissipating portions of the two heat sinks.

3. The LED lamp assembly as claimed in claim 1, wherein the heat dissipating portion comprises a plurality of radial fins and a sidewall enclosing outmost ends of the fins therein, the fins being spaced from each other and the outmost ends of the fins extending outwardly beyond the outmost end of the heat absorbing portion.

4. The LED lamp assembly as claimed in claim 2, wherein the heat absorbing portion comprises a connecting portion located at a centre of the first surface thereof, the connecting portions oriented towards each other, screws extending through the connecting portions to mount the LED lamps together.

5. The LED lamp assembly as claimed in claim 4, wherein a rear side of each of the connecting portions extends in rear of a rear side of a corresponding heat dissipating portion, and wherein when the heat sinks are mounted together, the channel between the heat sinks is defined around the connecting portions.

6. The LED lamp assembly as claimed in claim 5, wherein a lamp holder is located at a top of the LED lamp assembly, and a receiving member is located at a bottom of the LED lamp assembly, the connecting portion connecting with the lamp holder and the receiving member.

7. The LED lamp assembly as claimed in claim 1, wherein the heat absorbing portion comprises a heat absorbing plate and a sidewall extending outwardly from an edge of the heat absorbing plate, the LED modules being mounted on a second surface of the heat absorbing plate and being enclosed by the sidewall of the heat absorbing portion, the heat dissipating portion extending rearwards from a first surface opposite to the second surface of the heat absorbing plate.

8. The LED lamp assembly as claimed in claim 1, wherein each of the LED lamps further comprises a reflector mounted on the second surface of the heat absorbing portion.

9. The LED lamp assembly as claimed in claim 8, wherein the reflector comprises a reflecting portion defining a plurality of through holes corresponding to LEDs of the LED modules, a plurality of reflecting plates extending downwardly and outwardly from the reflecting portion, the reflecting plates each having a length similar to that of a corresponding LED module and reflecting light emitted from the corresponding LED module.

10. The LED lamp assembly as claimed in claim 9, further comprising an envelope mounted around a periphery of the heat sink to enclose the LED modules and the reflector therein.

11. The LED lamp assembly as claimed in claim 10, wherein a gasket is sandwiched between the envelope and the heat absorbing portion whereby the envelope and the heat absorbing portions are hermetically connected together.

12. An LED lamp assembly comprising:

a plurality of LED modules; and a heat sink supporting and cooling the LED modules, the heat sink comprising:

a pair of heat absorbing portions located at opposite sides of the LED lamp assembly, each of the heat absorbing portions comprising a first surface towards each other, and a second surface opposite to the first surface;

a pair of heat dissipating portions extending from the first surfaces of the heat absorbing portions and oriented towards each other, each of the heat dissipating portions having an outmost end extended beyond an outmost end of the heat absorbing portions; and a pair of reflectors mounted on the second surfaces of the heat absorbing portions;

wherein the LED modules are mounted on the second surfaces of the heat absorbing portion.

13. The LED lamp assembly as claimed in claim 12, wherein the heat dissipating portions are spaced from each other and a channel is defined therebetween.

14. The LED lamp assembly as claimed in claim 13, wherein a connecting porting is located between the heat dissipating portions and connecting the heat dissipating portions.

15. The LED lamp assembly as claimed in claim 14, wherein each of the heat dissipating portions comprises a plurality of radial fins and a sidewall enclosing outmost ends of the fins therein, the fins spaced from each other and the outmost ends of the fins extended outwardly beyond the outmost end of the heat absorbing portion.

16. The LED lamp assembly as claimed in claim 12, wherein each of the reflectors comprises a reflecting portion defined a plurality of through holes corresponding to LEDs of the LED modules, a plurality of reflecting plates extending downwardly and outwardly from the reflecting portion, the reflecting plates having a length similar to that of a corresponding LED module and reflecting light emitted from the corresponding LED module.

17. An LED lamp assembly comprising:

a pair of LED lamps assembled together, the LED lamps facing opposite directions, each of the LED lamps comprising:

a heat sink having a heat absorbing portion having a front face and a rear face, a plurality of fins extending rearwards from the rear face of heat absorbing portion of the heat sink, a connecting portion located at a middle of the rear face, wherein the connecting portion having a rear side in rear of a rear side of the fins, an outer end of each of the fins extending outwardly beyond a periphery of the heat absorbing portion, a sidewall interconnecting the outer ends of the fins so a plurality of apertures is defined between the sidewall, the outer ends of the fins and the periphery of the heat absorbing portion, the connecting portion of each of the heat sinks being connected with each other whereby a channel is defined between the fins and around the connecting portions of the heat sinks of the LED lamps; and a plurality of LED modules mounted on the front face of the heat absorbing portion of the heat sink of each of the LED lamps.

18. The LED lamp assembly as claimed in claim 17, further comprising a light reflector mounted to the front face of the heat absorbing portion, wherein the light reflector has a plurality of linear light reflecting plates each being located between two neighboring LED modules.

* * * * *